US011303054B2

(12) United States Patent
Ikeda

(10) Patent No.: US 11,303,054 B2
(45) Date of Patent: Apr. 12, 2022

(54) CONNECTION TERMINAL

(71) Applicant: Yazaki Corporation, Tokyo (JP)

(72) Inventor: Yukiyoshi Ikeda, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/197,231

(22) Filed: Mar. 10, 2021

(65) Prior Publication Data

US 2021/0288427 A1 Sep. 16, 2021

(30) Foreign Application Priority Data

Mar. 16, 2020 (JP) ..... JP2020-044988

(51) Int. Cl.

| | |
|---|---|
| ***H01R 13/11*** | (2006.01) |
| ***H01R 13/424*** | (2006.01) |
| ***H01R 13/436*** | (2006.01) |
| *H01R 4/18* | (2006.01) |

(52) U.S. Cl.

CPC ..... *H01R 13/11* (2013.01); *H01R 13/424* (2013.01); *H01R 13/4362* (2013.01); *H01R 4/185* (2013.01)

(58) Field of Classification Search

CPC ..... H01R 13/11; H01R 13/10; H01R 13/02; H01R 13/424; H01R 13/4362; H01R 13/111; H01R 13/112; H01R 13/113; H01R 13/114; H01R 13/115; H01R 13/187; H01R 4/185

USPC ..... 439/884, 352, 345, 346, 362, 364, 578, 439/619, 660, 678, 708, 723, 290, 607.01, 439/850, 852

See application file for complete search history.

(56) References Cited

U.S. PATENT DOCUMENTS

| | | | | |
|---|---|---|---|---|
| 6,095,873 | A * | 8/2000 | Muramatsu | H01R 11/22 439/852 |
| 6,386,928 | B2 * | 5/2002 | Kitamura | H01R 13/113 439/852 |
| 7,252,562 | B1 * | 8/2007 | Chen | H01R 13/187 439/852 |
| 7,311,561 | B2 | 12/2007 | Anbo et al. | |
| 7,530,859 | B2 * | 5/2009 | Moll | H01R 13/113 439/852 |

(Continued)

FOREIGN PATENT DOCUMENTS

| | | | |
|---|---|---|---|
| CN | 110268584 | A | 9/2019 |
| JP | 9-232021 | A | 9/1997 |

(Continued)

*Primary Examiner* — Harshad C Patel

(74) *Attorney, Agent, or Firm* — Sughrue Mion, PLLC

(57) ABSTRACT

In a connection terminal including a box-shaped connection portion having an insertion opening into which a mating connection portion is inserted, and an elastic piece that is elastically deformable, is arranged inside the connection portion, with an free end arranged on a side of the insertion opening, and has a contact portion that comes into contact with the mating connection portion, the connection portion is provided with a protective wall protruding toward an inside of the connection portion and arranged adjacent to the free end of the elastic piece, and a side of the free end of the elastic piece is arranged so as to intersect an extension line connecting a protruding end of the protective wall and an opening edge of the insertion opening facing the protruding end.

3 Claims, 10 Drawing Sheets

(56) References Cited

U.S. PATENT DOCUMENTS

| | | | | |
|---|---|---|---|---|
| 7,950,972 | B1 * | 5/2011 | Chen | H01R 13/111 439/852 |
| 7,976,351 | B2 * | 7/2011 | Boemmel | H01R 13/432 439/748 |
| 2001/0002350 | A1 * | 5/2001 | Kashiyama | H01R 13/11 439/852 |
| 2001/0024913 | A1 * | 9/2001 | Kitamura | H01R 13/113 439/852 |
| 2003/0096533 | A1 * | 5/2003 | Kojima | H01R 13/187 439/595 |
| 2008/0280510 | A1 * | 11/2008 | Moll | H01R 13/113 439/877 |
| 2009/0036001 | A1 * | 2/2009 | Ishigami | H01R 4/184 439/816 |
| 2010/0197177 | A1 * | 8/2010 | Myer | H01R 13/187 439/852 |
| 2012/0142233 | A1 * | 6/2012 | Blasko | H01R 13/113 439/852 |
| 2012/0244756 | A1 | 9/2012 | Jouas et al. | |

FOREIGN PATENT DOCUMENTS

| | | | |
|---|---|---|---|
| JP | 11-45750 | A | 2/1999 |
| JP | 4030673 | B2 | 1/2008 |
| JP | 2015-207372 | A | 11/2015 |

* cited by examiner

CONNECTION TERMINAL

CROSS-REFERENCE TO RELATED APPLICATIONS

The present application is based on, and claims priority from Japanese Patent Application No. 2020-044988, filed on Mar. 16, 2020, the entire contents of which are incorporated herein by reference.

TECHNICAL FIELD

The present application relates to a connection terminal.

BACKGROUND

The connection terminal of JP 2015-207372 A includes a box-shaped connection portion having an insertion opening into which a male terminal as a mating connection portion is inserted. Inside the connection portion, a free end is arranged on the side of the insertion opening, and a contact spring piece as an elastically deformable elastic piece having a contact portion that comes into contact with the male terminal is provided.

SUMMARY

The connection terminal of JP 2015-207372 A is accommodated in the housing of the connector. A locking lance that can be bent is provided in the housing, and the locking lance engages with the connection terminal to prevent the connection terminal from coming off. When the connection terminal is removed from the housing for maintenance or the like, a release jig is inserted into the housing to bend the locking lance and disengage the locking lance from the connection terminal.

However, when an erroneous insertion occurs in which the release jig is inserted while being tilted with respect to the insertion opening of the connection terminal, the release jig passes over the protruding end of the protective wall, and the release jig may interfere with the free end of the elastic piece.

An object of the present application is to provide a connection terminal capable of protecting an elastic piece when a member is erroneously inserted into a connection portion.

A connection terminal according to an embodiment includes a box-shaped connection portion having an insertion opening into which a mating connection portion is inserted, and an elastic piece that is elastically deformable, is arranged inside the connection portion, with an end portion on a side of the insertion opening as a free end, and has a contact portion that comes into contact with the mating connection portion, and the connection portion is provided with a protective wall having a protruding end protruding toward an inside of the connection portion and arranged adjacent to the free end of the elastic piece, and an end portion on a side of the free end of the elastic piece is arranged so as to intersect an extension line connecting the protruding end of the protective wall and an opening edge of the insertion opening facing the protruding end.

It is preferable that the protective wall is arranged on an inner side of the connection portion from the insertion opening.

It is preferable that a portion facing the free end of the elastic piece in the connection portion is provided with a hole into which the free end of the elastic piece can be inserted when the elastic piece is elastically deformed.

According to the above configuration, it is possible to provide a connection terminal capable of protecting the elastic piece when a member is erroneously inserted into the connection portion.

DETAILED DESCRIPTION

Figure 1:
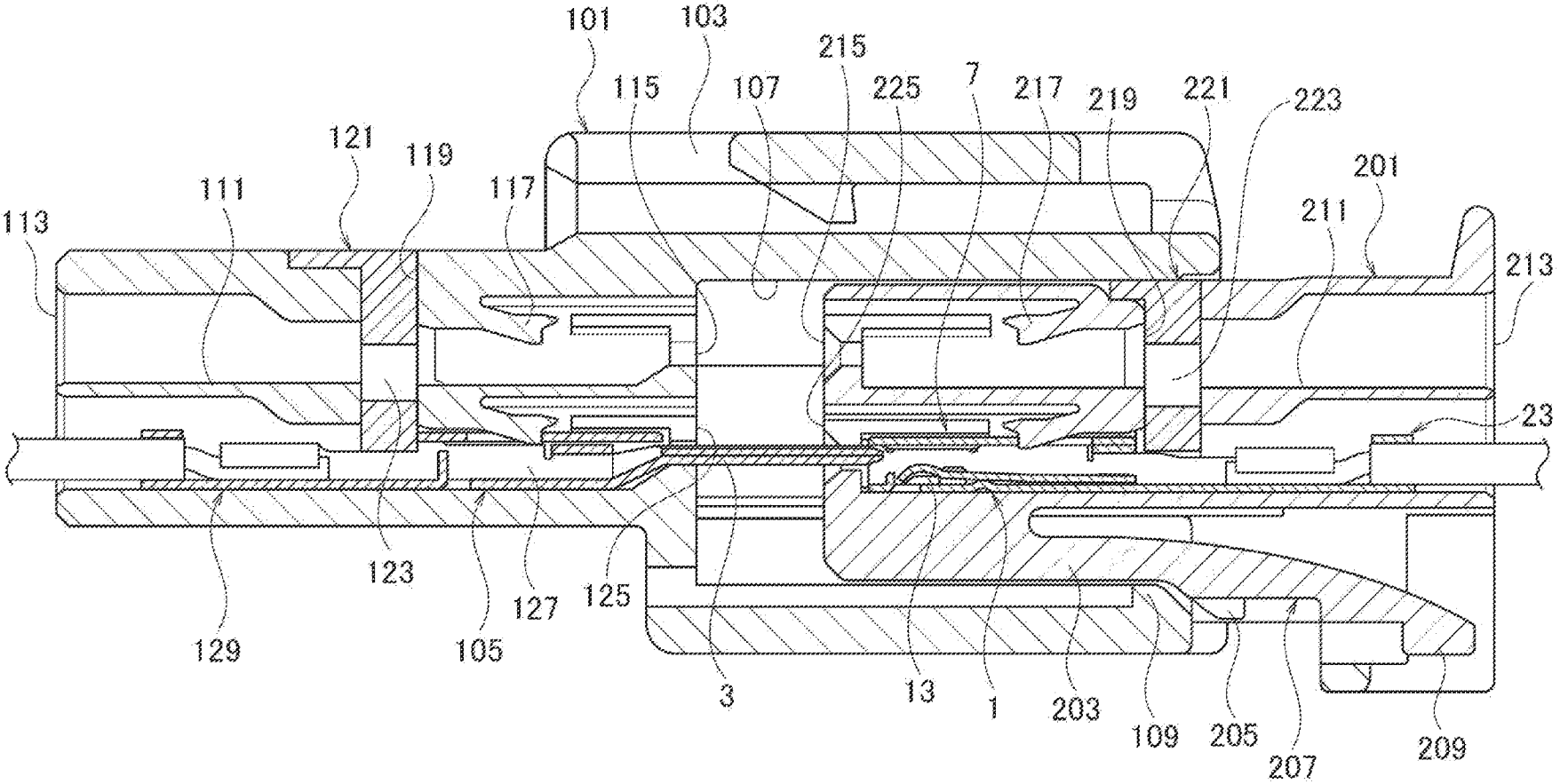
FIG. 1 is a cross-sectional view when a connector accommodating a connection terminal according to a present embodiment and a mating connector are fitted.
Figure 2:
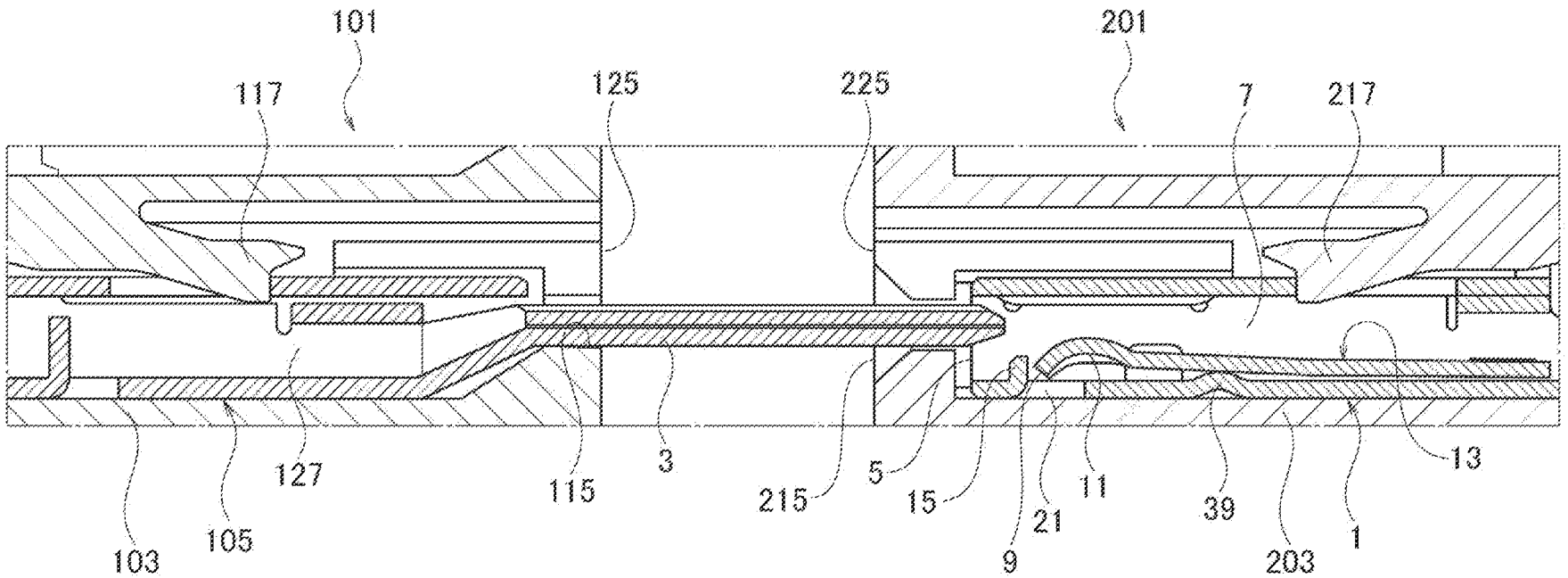
FIG. 2 is an enlarged view of a main part of FIG. 1.
Figure 3:
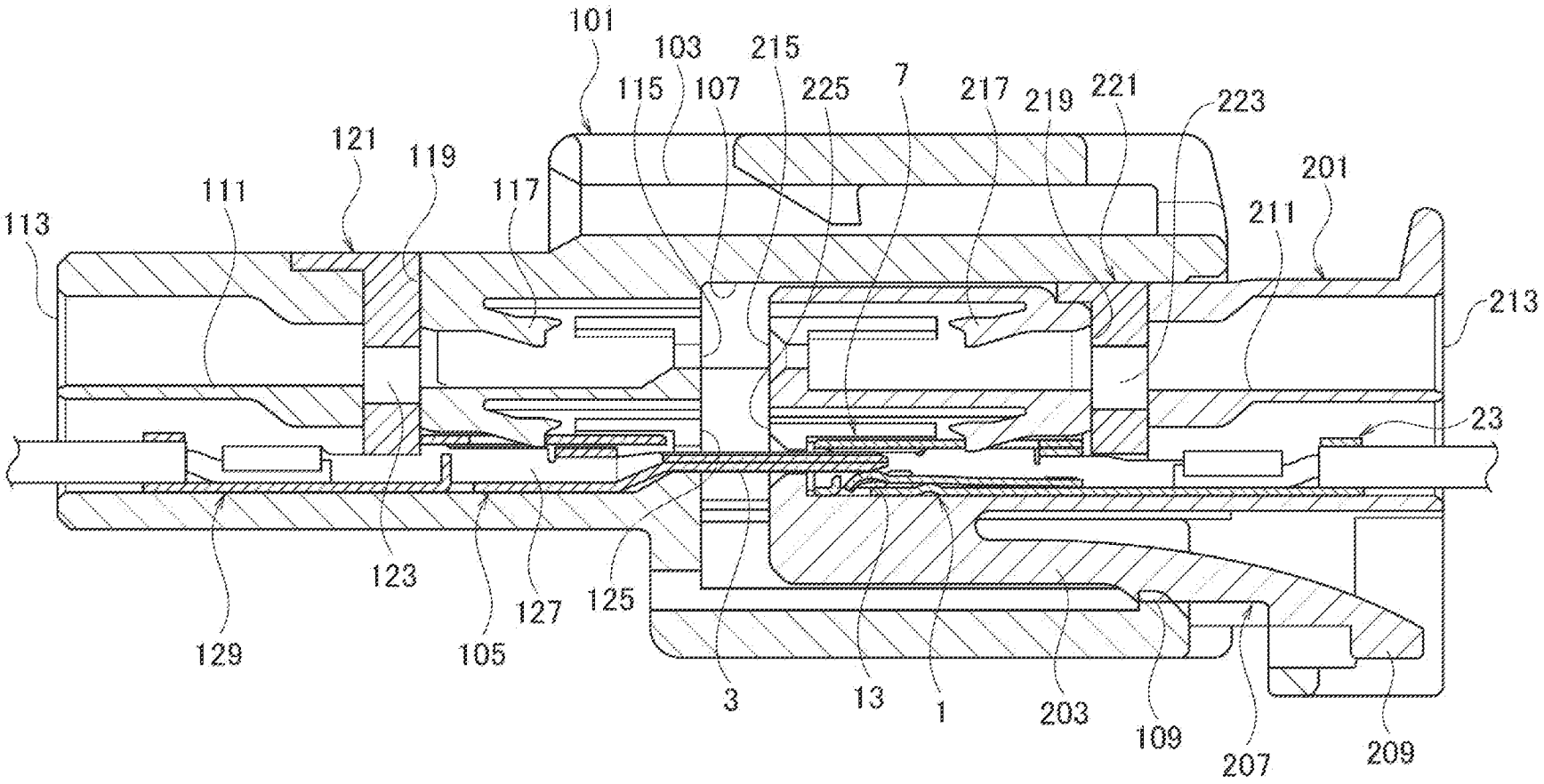
FIG. 3 is a cross-sectional view when the connector accommodating the connection terminal according to the present embodiment and the mating connector are fitted.
Figure 4:
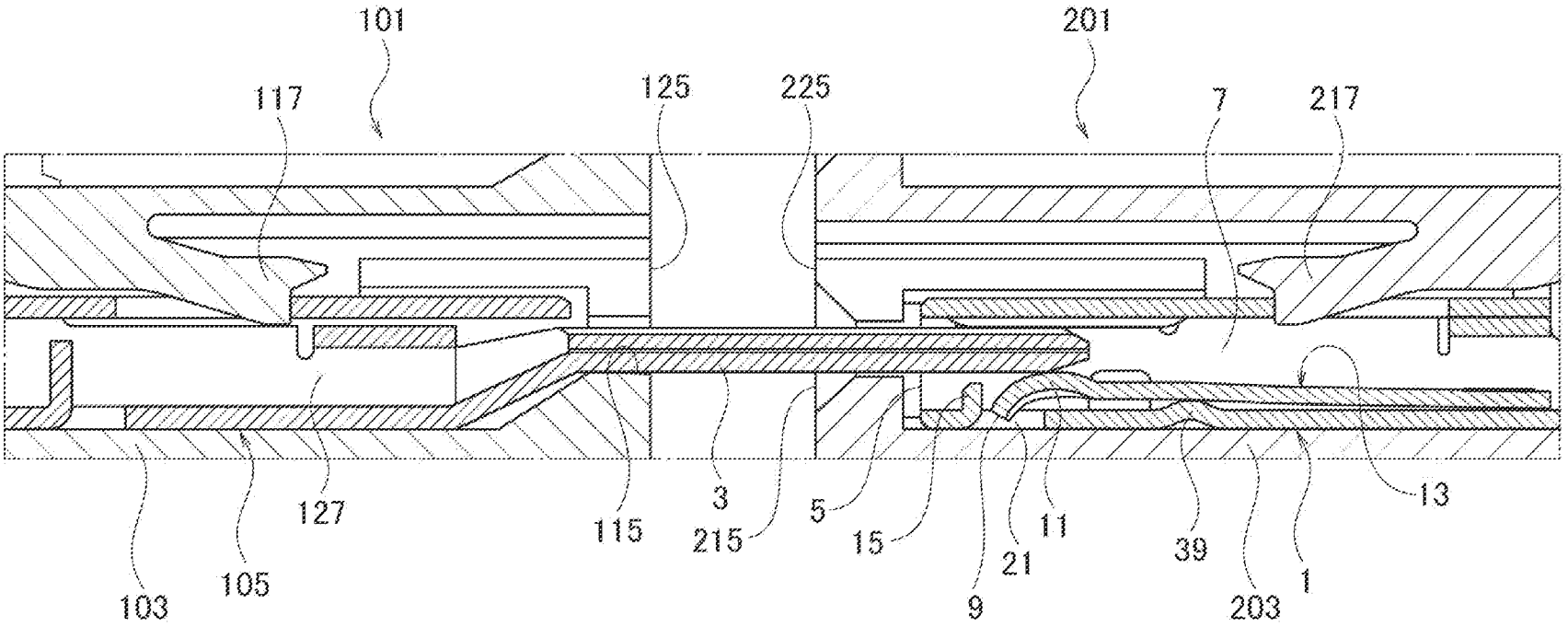
FIG. 4 is an enlarged view of a main part of FIG. 3.
Figure 5:
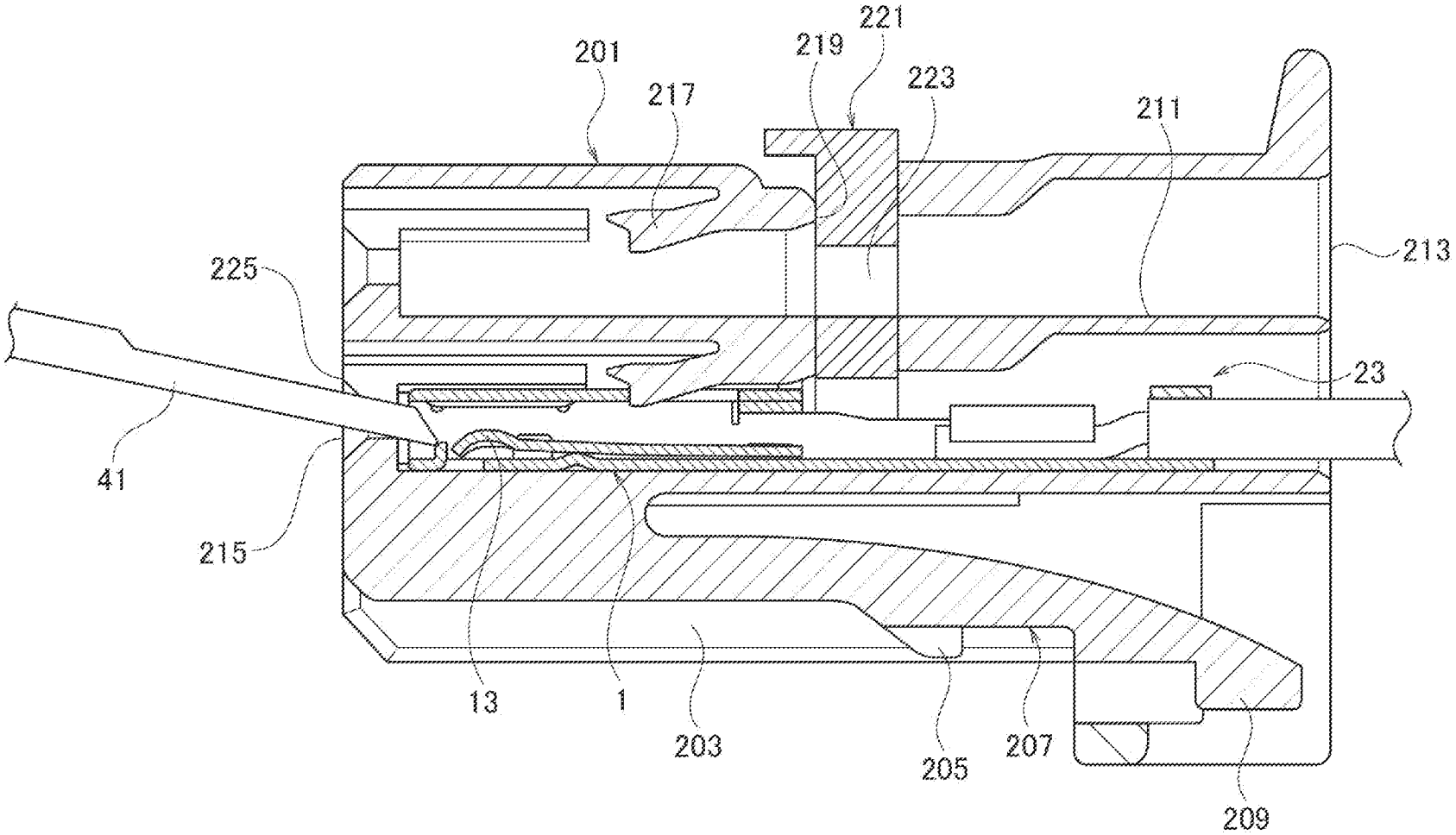
FIG. 5 is a cross-sectional view when a release jig is erroneously inserted when the connection terminal according to the present embodiment is pulled out from the connector.

Hereinafter, a connection terminal according to a present embodiment will be described in detail with reference to the drawings. The dimensional ratios in the drawings are exaggerated for convenience of explanation and may differ from the actual ratios.

A connection terminal 1 according to the present embodiment includes a box-shaped connection portion 7 having an insertion opening 5 into which a mating connection portion 3 is inserted, and an elastic piece 13 that is elastically deformable, is arranged inside the connection portion 7, with an end portion on a side of the insertion opening 5 as a free end 9, and has a contact portion 11 that comes into contact with the mating connection portion 3.

The connection portion 7 is provided with a protective wall 15 having a protruding end 17 protruding toward an inside of the connection portion 7, and arranged adjacent to the free end 9 of the elastic piece 13.

An end portion on a side of the free end 9 of the elastic piece 13 is arranged so as to intersect an extension line L connecting the protruding end 17 of the protective wall 15 and an opening edge 19 of the insertion opening 5 facing the protruding end 17.

The protective wall 15 is arranged on an inner side of the connection portion 7 from the insertion opening 5.

A portion facing the free end 9 of the elastic piece 13 in the connection portion 7 is provided with a hole 21 into which the free end 9 of the elastic piece 13 can be inserted when the elastic piece 13 is elastically deformed.

As illustrated in FIGS. 1 to 4, the connection terminal 1 according to the present embodiment is applied to a connector 201 that can be fitted with a mating connector 101. By fitting the connector 201 with the mating connector 101, the connection terminal 1 and a mating terminal 105 are electrically connected.

As illustrated in FIGS. 1 to 4, the mating connector 101 includes a mating housing 103 and a mating terminal 105.

As illustrated in FIGS. 1 to 4, the mating housing 103 is made of an insulating material such as a synthetic resin and is formed in a housing shape. The mating housing 103 is provided with a fitting portion 107 in which one end side is opened and a housing 203 is fitted inside. A locked portion 109 is provided and protrudes inside the fitting portion 107. Mating terminal accommodating chambers 111 are provided on a bottom side of the fitting portion 107.

The mating terminal accommodating chambers 111 are arranged in a plurality of stages in a height direction of the mating housing 103 and in a plurality of rows in a width direction of the mating housing 103. The mating terminal accommodating chambers 111 each have an accommodating opening 113 on one end side in a length direction and a connection opening 115 on another end side in the length direction.

The mating terminal 105 is inserted into the accommodating opening 113 from a side of the mating connection portion 3, and the mating terminal 105 is accommodated in a corresponding one of the mating terminal accommodating chambers 111. The mating connection portion 3 of the mating terminal 105 is inserted into the connection opening 115 while the mating terminal 105 is accommodated in the mating terminal accommodating chamber 111, and the mating connection portion 3 is arranged in the fitting portion 107. The mating terminal 105 accommodated in the upper mating terminal accommodating chamber 111 is not illustrated. A mating locking lance 117 is provided in the mating terminal accommodating chamber 111 and can be bent in the height direction.

The mating locking lance 117 extends along the length direction of the mating terminal accommodating chamber 111 so that a side of an inner wall surface of the mating terminal accommodating chamber 111 serves as a base end and a side of the connection opening 115 serves as a free end, and can be bent in the height direction. When the mating terminal 105 is inserted into the mating terminal accommodating chamber 111, a side of the free end of the mating locking lance 117 slides with the mating terminal 105 and is bent upward.

When the mating terminal 105 is located at a regular position of the mating terminal accommodating chamber 111, the mating locking lance 117 is restored downward and engaged with the mating terminal 105. Through the engagement between the mating locking lance 117 and the mating terminal 105, the mating terminal 105 is prevented from coming off from the accommodating opening 113.

In the mating terminal accommodating chamber 111 in which the mating terminal 105 is prevented from coming off by the mating locking lance 117, a mating side spacer 121 is accommodated in an accommodating hole 119 provided so as to communicate the plurality of mating terminal accommodating chambers 111. An insertion hole 123 through which the mating terminal 105 can be inserted is formed in the mating side spacer 121, and a temporary locking position and a main locking position with respect to the accommodating hole 119 are held via an engaging means (not illustrated).

When the mating terminal 105 is accommodated in the mating terminal accommodating chamber 111, the mating side spacer 121 is held at the temporary locking position with respect to the accommodating hole 119. At the temporary locking position, the mating terminal 105 can be inserted into the insertion hole 123, and the mating side spacer 121 does not interfere with the mating terminal 105.

The mating side spacer 121 is held at the main locking position with respect to the accommodating hole 119 when the mating terminal 105 is located at the regular position of the mating terminal accommodating chamber 111. At the main locking position, the mating side spacer 121 engages with the mating terminal 105, and the mating terminal 105 is doubly prevented from coming off from the accommodating opening 113.

The mating housing 103 is provided with a release opening 125, above the connection opening 115, into which a release jig for bending the mating locking lance 117 upward is inserted. When the mating terminal 105 is pulled out from the mating terminal accommodating chamber 111 for maintenance or the like, the release jig is inserted into the release opening 125 while the mating side spacer 121 is held at the temporary locking position.

The release jig is brought into contact with the mating locking lance 117, and bend the mating locking lance 117 upward. Due to the bending of the mating locking lance 117, the engagement between the mating locking lance 117 and the mating terminal 105 is released, and the mating terminal 105 can be pulled out from the accommodating opening 113.

As illustrated in FIGS. 1 to 4, the mating terminal 105 is formed by performing a punching process, a bending process, or the like on a single plate material made of a conductive material. The mating terminal 105 has a box portion 127 formed at the center thereof, which is engaged with the mating locking lance 117 and the mating side spacer 121. On one side of a box portion 127, a cable connection portion 129 is formed of one member continuous with the box portion 127. On another side of the box portion 127, the mating connection portion 3 is formed of one member continuous with the box portion 127.

The cable connection portion 129 is composed of a pair of swaging pieces, and is crimped by swaging a core cable portion exposed from a sheath portion of a cable at a terminal portion of the cable connected to a power source, equipment, or the like. By crimping the cable connection portion 129 to the core cable portion of the cable, the mating terminal 105 is electrically connected to the cable.

The mating connection portion 3 is formed of one member continuous with the cable connection portion 129 via the box portion 127. The mating connection portion 3 is a male connection portion extending in a tab shape from the box portion 127 in a fitting direction between the mating connector 101 and the connector 201.

The mating connection portion 3 is arranged in the fitting portion 107 through the connection opening 115 in a state where the mating terminal 105 is accommodated in the mating terminal accommodating chamber 111. The mating connection portion 3 arranged in the fitting portion 107 is electrically connected to the connection terminal 1 in a state where the mating connector 101 and the connector 201 are fitted.

As illustrated in FIGS. 1 to 10, the connector 201 includes the housing 203 and the connection terminal 1.

As illustrated in FIGS. 1 to 7, the housing 203 is made of an insulating material such as a synthetic resin, and is formed in a housing shape that can be fitted in the fitting portion 107 of the mating housing 103. A lock arm 207 is provided on an outer periphery of the housing 203 and can be bent, and a lock portion 205 that engages with the locked portion 109 of the fitting portion 107 protrudes from the lock arm 207.

The locked portion 109 and the lock portion 205 are engaged with each other in a state where the mating connector 101 and the connector 201 are fitted. Through the engagement between the locked portion 109 and the lock portion 205, the fitting state of the mating connector 101 and the connector 201 is maintained.

The lock arm 207 is provided with an operation unit 209. The operation unit 209 bends the lock arm 207 by being pressed when the fitting of the mating connector 101 and the connector 201 is released. Due to the bending of the lock arm 207, the engagement between the locked portion 109 and the lock portion 205 is released, so that the fitting between the mating connector 101 and the connector 201 can be released. Terminal accommodating chambers 211 are provided inside the housing 203 provided with the lock arm 207.

The terminal accommodating chambers 211 are arranged in a plurality of stages in the height direction of the housing 203, and are arranged in a plurality of rows in the width direction of the housing 203. The terminal accommodating chambers 211 each have an accommodating opening 213 on one end side in the length direction and a connection opening 215 on another end side in the length direction.

The connection terminal 1 is inserted into the accommodating opening 213 from a side of the connection portion 7, and the connection terminal 1 is accommodated in a corresponding one of the terminal accommodating chambers 211. By fitting the mating connector 101 and the connector 201, the mating connection portion 3 of the mating terminal 105 is inserted into the connection opening 215. By inserting the mating connection portion 3 into the connection opening 215, the mating terminal 105 and the connection terminal 1 are electrically connected. The connection terminal 1 accommodated in the upper terminal accommodating chamber 211 is not illustrated. A locking lance 217 is provided in the terminal accommodating chamber 211 and can be bent in the height direction.

The locking lance 217 extends along the length direction of the terminal accommodating chamber 211 so that a side of an inner wall surface of the terminal accommodating chamber 211 serves as a base end and a side of the connection opening 215 serves as a free end, and can be bent in the height direction. When the connection terminal 1 is inserted into the terminal accommodating chamber 211, a side of the free end of the locking lance 217 slides with the connection terminal 1 and is bent upward.

When the connection terminal 1 is located at a regular position of the terminal accommodating chamber 211, the locking lance 217 is restored downward and engaged with the connection terminal 1. Through the engagement between the locking lance 217 and the connection terminal 1, the connection terminal 1 is prevented from coming off from the accommodating opening 213.

In the terminal accommodating chamber 211 in which the connection terminal 1 is prevented from coming off by the locking lance 217, a side spacer 221 is accommodated in an accommodating hole 219 provided so as to communicate the plurality of terminal accommodating chambers 211. An insertion hole 223 through which the connection terminal 1 can be inserted is formed in the side spacer 221, and a temporary locking position and a main locking position with respect to the accommodating hole 219 are held via an engaging means (not illustrated).

When the connection terminal 1 is accommodated in the terminal accommodating chamber 211, the side spacer 221 is held at the temporary locking position with respect to the accommodating hole 219. At the temporary locking position, the connection terminal 1 can be inserted into the insertion hole 223, and the side spacer 221 does not interfere with the connection terminal 1.

The side spacer 221 is held at the main locking position with respect to the accommodating hole 219 when the connection terminal 1 is located at the regular position of the terminal accommodating chamber 211. At the main locking position, the side spacer 221 engages with the connection terminal 1, and the connection terminal 1 is doubly prevented from coming off from the accommodating opening 213.

The housing 203 is provided with a release opening 225, above the connection opening 215, into which a release jig 41 for bending the locking lance 217 upward is inserted. When the connection terminal 1 is pulled out from the terminal accommodating chamber 211 for maintenance or the like, the release jig 41 is inserted into the release opening 225 as illustrated by a virtual line in FIG. 6 while the side spacer 221 is held at the temporary locking position.

The release jig 41 is brought into contact with the locking lance 217, and the locking lance 217 is bent upward by the release jig 41. Due to the bending of the locking lance 217, the engagement between the locking lance 217 and the connection terminal 1 is released, and the connection terminal 1 can be pulled out from the accommodating opening 213.

As illustrated in FIGS. 1 to 10, the connection terminal 1 is formed by performing a punching process, a bending process, or the like on a single plate material made of a conductive material. The connection terminal 1 is formed of one member continuous with a cable connection portion 23 and the connection portion 7. The cable connection portion 23 includes a sheath crimping portion 25 and a core cable crimping portion 27.

The sheath crimping portion 25 is composed of a pair of swaging pieces, and swages a sheath portion 31 of a cable 29 at a terminal portion of the cable 29 connected to a power source, equipment, or the like. The connection terminal 1 is fixed to the cable 29 by swaging the sheath crimping portion 25 to the sheath portion 31 of the cable 29. A plurality of grooves are formed in the sheath crimping portion 25, and the sheath portion 31 of the cable 29 bites into the grooves to strengthen the fixing of the connection terminal 1 and the cable 29.

The core cable crimping portion 27 is composed of a pair of crimping pieces provided between the connection portion 7 and the sheath crimping portion 25, and a core cable portion 33 exposed from the sheath portion 31 of the cable 29 is swaged so as to be crimped at the terminal portion of the cable 29. By crimping the core cable crimping portion 27 to the core cable portion 33 of the cable 29, the connection terminal 1 is electrically connected to the cable 29. A surface of the core cable crimping portion 27 is formed in a grid pattern, and when the core cable portion 33 is swaged, an oxide film formed on the surface of the core cable portion 33 is destroyed. Due to the destruction of the oxide film, a new surface of the core cable portion 33 and the core cable crimping portion 27 come into contact with each other, and electrical connection reliability can be improved.

The connection portion 7 is a female type connection portion in which a bottom wall and both side walls are formed of one member continuous with the cable connection portion 23, and the both side walls, an upper wall, and the bottom wall are bent to form a box shape. A lance engaging portion 35 and a spacer engaging portion 37 are provided on an outer periphery of the box-shaped connection portion 7.

The lance engaging portion 35 is an edge portion of a hole formed through the upper wall of the connection portion 7. The locking lance 217 is engaged with the lance engaging portion 35 in a state where the connection terminal 1 is accommodated in the regular position of the terminal accommodating chamber 211.

The spacer engaging portion 37 is an edge portion on a side of the cable connection portion 23 of the upper wall of the connection portion 7. The connection terminal 1 is accommodated at the regular position of the terminal accommodating chamber 211, and the side spacer 221 is engaged with the spacer engaging portion 37 at the main locking position of the side spacer 221. The insertion opening 5 is provided on the side of the box-shaped connection portion 7 opposite to the cable connection portion 23.

The insertion opening 5 coincides with the connection opening 215 of the housing 203 in a state where the connection terminal 1 is accommodated at the regular position of the terminal accommodating chamber 211. By fitting the mating connector 101 and the connector 201, the mating connection portion 3 of the mating terminal 105 is inserted into the insertion opening 5. The elastic piece 13, the protective wall 15, and the hole 21 are provided inside the box-shaped connection portion 7.

The elastic piece 13 that is elastically deformable is arranged inside the box-shaped connection portion 7 with an end portion on the side of the cable connection portion 23 superimposed on the bottom wall of the box-shaped connection portion 7 as a base end and an end portion on the side of the insertion opening 5 facing the side of the bottom wall of the connection portion 7 as the free end 9.

On the side of the free end 9 of the elastic piece 13, the contact portion 11 that comes into contact with the mating connection portion 3 is provided by ejecting the elastic piece 13. The contact portion 11 contacts the mating connection portion 3 in a state where the mating connection portion 3 is inserted in the box-shaped connection portion 7, and displaces the elastic piece 13 downward.

Due to the displacement of the elastic piece 13, the contact portion 11 is brought into contact with the mating connection portion 3 by urging force of the elastic piece 13 to be restored. By the contact between the contact portion 11 and the mating connection portion 3, the mating terminal 105 and the connection terminal 1 are electrically connected.

A fulcrum portion 39 protrudes from the bottom wall of the box-shaped connection portion 7 toward the elastic piece 13. The fulcrum portion 39 is brought into contact with a side of the base end of the elastic piece 13 from the contact portion 11. The fulcrum portion 39 serves as a fulcrum when the elastic piece 13 is elastically deformed when the contact portion 11 comes into contact with the mating connection portion 3.

By providing the fulcrum portion 39, a portion of the elastic piece 13 to be elastically deformed can be shortened, and elastic deformation force of the elastic piece 13 can be increased. Therefore, contact pressure between the contact portion 11 and the mating connection portion 3 can be increased, and the electrical connection reliability between the mating terminal 105 and the connection terminal 1 can be improved.

The protective wall 15 is formed by cutting and raising the bottom wall of the connection portion 7 facing the free end 9 of the elastic piece 13 toward the inside of the connection portion 7, so that the protective wall 15 stands adjacent to the free end 9 of the elastic piece 13 with respect to an insertion direction of the mating connection portion 3. The protective wall 15 is arranged on the inner side of the connection portion 7 from the insertion opening 5 with respect to the insertion direction of the mating connection portion 3. By arranging the protective wall 15 on the inner side of the connection portion 7, it is not necessary to form notches and the like on both sides in a width direction of the protective wall 15 as in the case where the protective wall 15 is arranged in the insertion opening 5, and thus strength of the connection portion 7 can be maintained.

As for a protruding height of the protective wall 15, when the inner side of the connection portion 7 is viewed from the side of the insertion opening 5, the free end 9 of the elastic piece 13 is not visible, and the contact portion 11 of the elastic piece 13 is visible above the protruding end 17 of the protective wall 15. By providing the protective wall 15 in this way, when the mating connection portion 3 is inserted through the insertion opening 5, the mating connection portion 3 is passed over the protruding end 17 of the protective wall 15, and the mating connection portion 3 can be stably contacted with the contact portion 11 of the elastic piece 13.

At this time, since the free end 9 of the elastic piece 13 is located below the protruding end 17 of the protective wall 15, the free end 9 of the elastic piece 13 and the mating connection portion 3 do not interfere with each other. Therefore, it is possible to prevent plastic deformation of the elastic piece 13 due to interference between the free end 9 of the elastic piece 13 and the mating connection portion 3.

The hole 21 is a through hole formed so as to penetrate the bottom wall of the connection portion 7 when the protective wall 15 is cut and raised. The hole 21 is arranged so as to face the free end 9 of the elastic piece 13 with respect to a deformation direction of the elastic piece 13 when the contact portion 11 comes into contact with the mating connection portion 3. When the contact portion 11 comes into contact with the mating connection portion 3 and the elastic piece 13 is deformed downward, the free end 9 of the elastic piece 13 is inserted into the hole 21.

By providing the connection portion 7 with the hole 21 into which the free end 9 of the elastic piece 13 can be inserted, elastic deformation force of the elastic piece 13 can be increased without increasing the size of the connection portion 7. Therefore, contact pressure between the contact portion 11 and the mating connection portion 3 can be increased, and the electrical connection reliability between the mating terminal 105 and the connection terminal 1 can be improved.

In the connector 201 in which the connection terminal 1 is accommodated, when the connection terminal 1 is pulled out from the terminal accommodating chamber 211 for maintenance or the like, the release jig 41 is inserted into the release opening 225 as described above. Since the release opening 225 is provided adjacent to the connection opening 215, the release jig 41 can be erroneously inserted into the connection opening 215, and the release jig 41 may be inserted into the connection portion 7 through the insertion opening 5.

At this time, when the release jig 41 is inserted along the insertion direction of the mating connection portion 3, the free end 9 of the elastic piece 13 can be protected by the protective wall 15. For erroneous insertion of the release jig 41 along the insertion direction of the mating connection portion 3, even if distance between the protective wall 15 and the free end 9 of the elastic piece 13 is large, the free end 9 can be protected by the protective wall 15.

On the other hand, the release jig 41 may be inserted into the connection portion 7 through the insertion opening 5 while being tilted with respect to the insertion direction of the mating connection portion 3. In this case, if the distance between the protective wall 15 and the free end 9 of the elastic piece 13 is large, the release jig 41 gets over the protruding end 17 of the protective wall 15 and interferes with the free end 9 of the elastic piece 13. When such interference occurs, when the release jig 41 enters below the free end 9, the elastic piece 13 is deformed in a direction opposite to an elastic deformation direction. Moreover, the release jig 41 pushes the free end 9 in the insertion direction, and the elastic piece 13 is deformed in the insertion direction, so that the elastic piece 13 may be plastically deformed.

Figure 10:
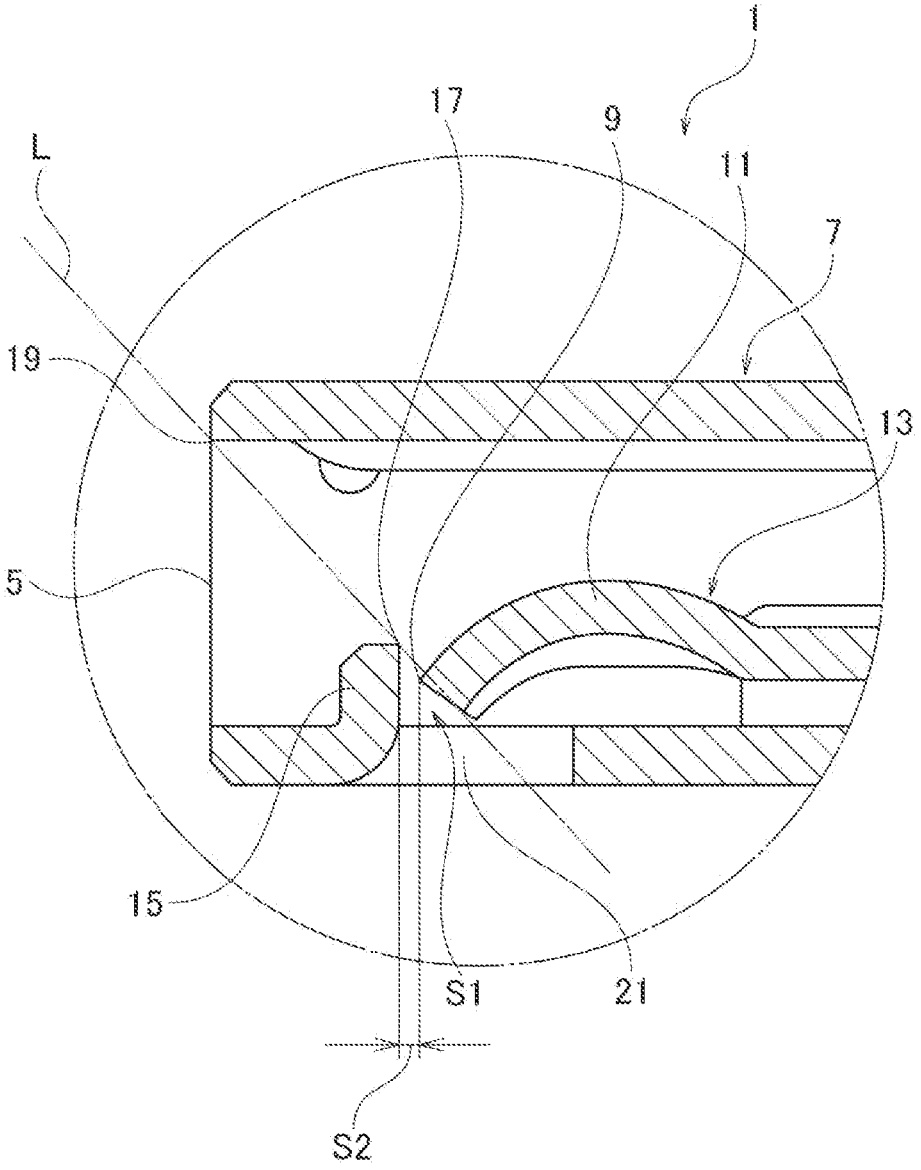
FIG. 10 is an enlarged cross-sectional view of a main part of the connection terminal according to the present embodiment.

Therefore, as illustrated in FIG. 10, the side of the free end 9 of the elastic piece 13 is arranged so as to intersect the extension line L connecting the protruding end 17 of the protective wall 15 and the opening edge 19 of the insertion opening 5 facing the protruding end 17. Specifically, the free end 9 of the elastic piece 13 is arranged in a space S1 partitioned by the extension line L, the protective wall 15, and the bottom wall of the connection portion 7.

By arranging the free end 9 of the elastic piece 13 in this way, for example, even if the release jig 41 is tilted to the maximum along the extension line L and inserted into the insertion opening 5, the release jig 41 does not interfere with the free end 9 of the elastic piece 13. Therefore, it is possible to prevent the elastic piece 13 from being plastically deformed due to the interference between the release jig 41 and the free end 9.

The protective wall 15 is arranged on an inner side of the connection portion 7 from the insertion opening 5. By arranging the protective wall 15 in this way, a gap S2 between the protective wall 15 and the free end 9 of the elastic piece 13 in the insertion direction can be reduced. By reducing the gap S2 between the protective wall 15 and the free end 9, even if the release jig 41 is erroneously inserted, the interference between the release jig 41 and the free end 9 can be prevented. The gap S2 between the protective wall 15 and the free end 9 is set so that the free end 9 does not come into contact with the protective wall 15 when the elastic piece 13 is elastically deformed.

Figure 6:
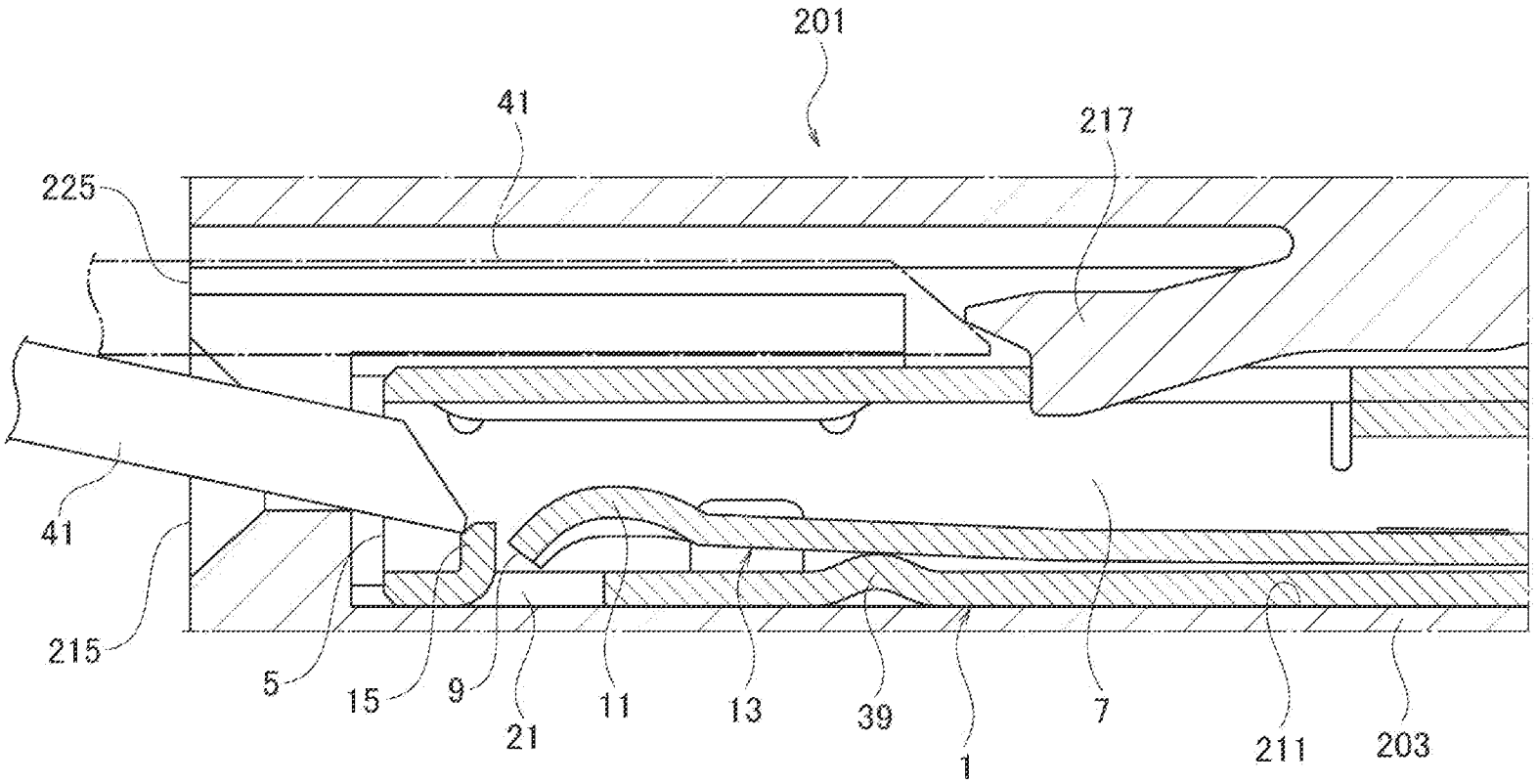
FIG. 6 is an enlarged view of a main part of FIG. 5.
Figure 7:
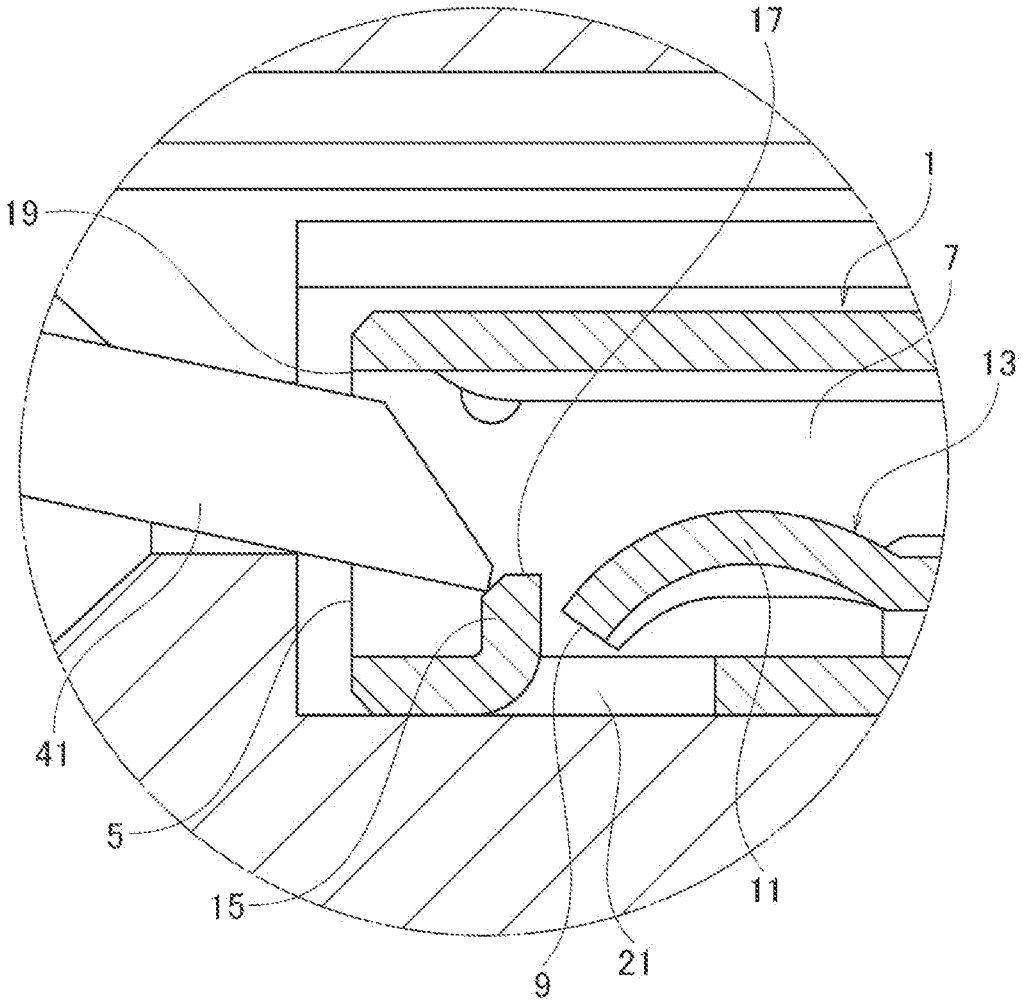
FIG. 7 is an enlarged view of a main part of FIG. 6.
Figure 8:
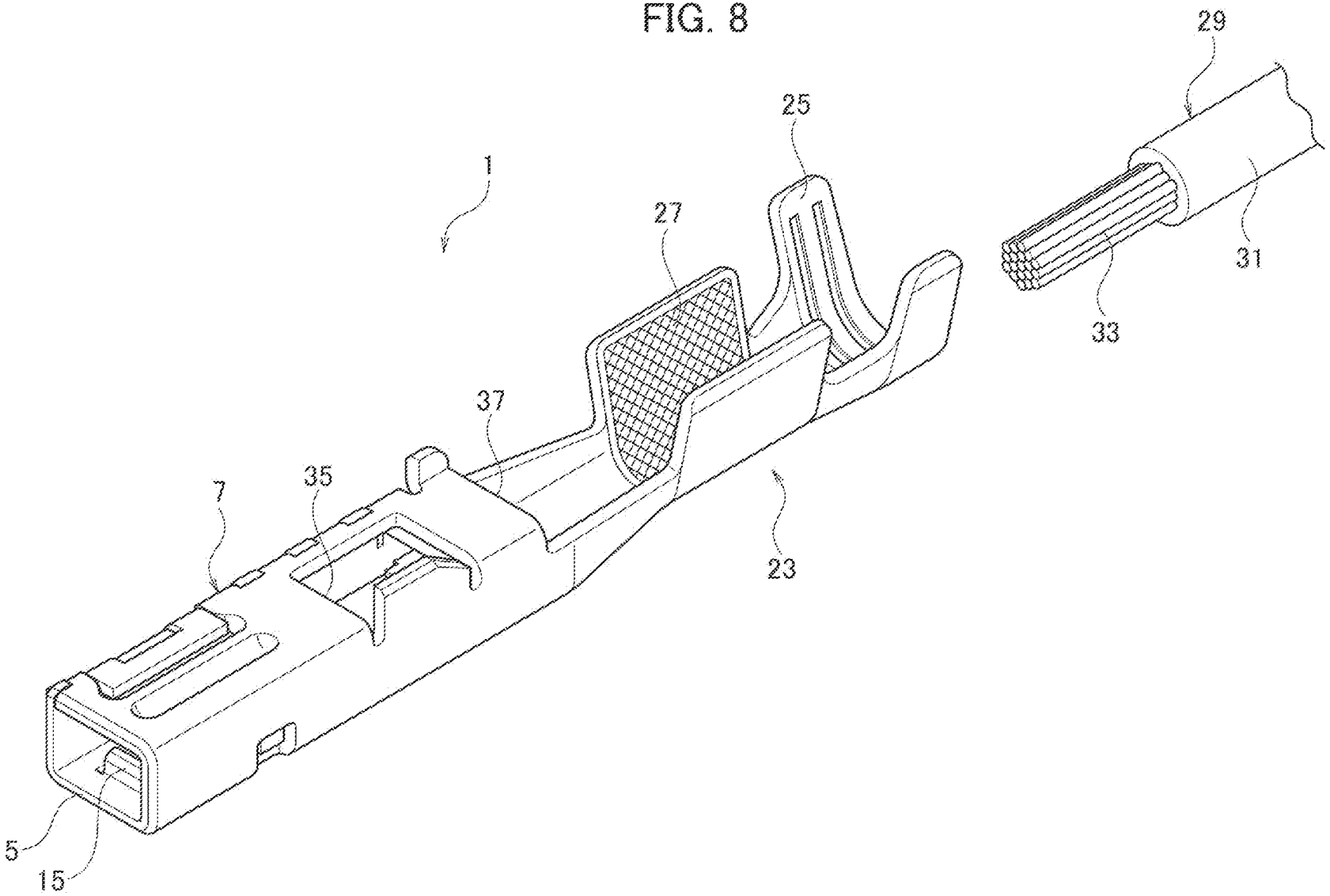
FIG. 8 is a perspective view of the connection terminal according to the present embodiment and a cable.
Figure 9:
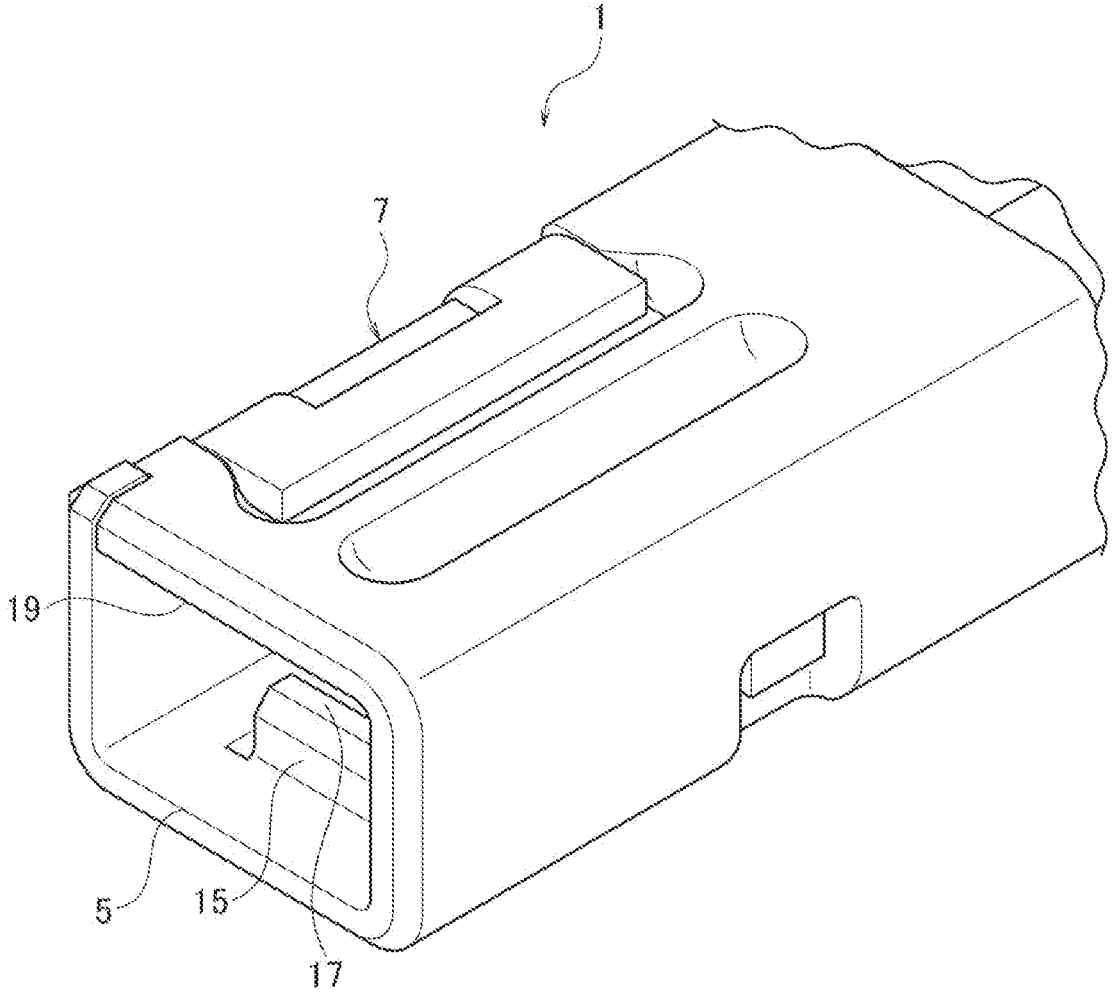
FIG. 9 is an enlarged perspective view of a main part of the connection terminal according to the present embodiment.

By arranging the protective wall 15 on the inner side of the connection portion 7 from the insertion opening 5, for example, when the release jig 41 is tilted to some extent and inserted into the insertion opening 5, as illustrated in FIG. 6, the release jig 41 and the protective wall 15 can be easily brought into contact with each other. Therefore, as compared with the case where the protective wall 15 is provided in the insertion opening 5, the protective wall 15 can reliably protect the elastic piece 13 from a member erroneously inserted into the connection portion 7.

In the connection terminal 1, an end portion on the side of the free end 9 (side surface on the side of the free end 9) of the elastic piece 13 is arranged so as to intersect the extension line L connecting the protruding end 17 of the protective wall 15 and the opening edge 19 of the insertion opening 5 on a side facing the protruding end 17 at an opening edge of the insertion opening 5. Therefore, even if a member is erroneously inserted through the insertion opening 5 while being tilted, the free end 9 of the elastic piece 13 does not interfere with the erroneously inserted member. Therefore, it is possible to prevent the elastic piece 13 from being plastically deformed due to the interference between the erroneously inserted member and the free end 9.

Therefore, the connection terminal 1 can protect the elastic piece 13 when the member is erroneously inserted into the connection portion 7.

The protective wall 15 is arranged on an inner side of the connection portion 7 from the insertion opening 5. Therefore, when the member is erroneously inserted through the insertion opening 5 while being tilted, the protective wall 15 and the erroneously inserted member can be easily brought into contact with each other. Therefore, the protective wall 15 can stably protect the elastic piece 13.

A portion of the connection portion 7 facing the free end 9 of the elastic piece 13 (side of elastic deformation) is provided with the hole 21 into which the free end 9 of the elastic piece 13 can be inserted when the elastic piece 13 is elastically deformed. Therefore, the elastic deformation force of the elastic piece 13 can be increased without increasing the size of the connection portion 7. Therefore, the contact pressure between the contact portion 11 and the mating connection portion 3 can be increased, and the electrical connection reliability can be improved.

Next, a comparative example will be described. In a connection terminal according to the comparative example, when a male terminal is inserted through an insertion opening, a contact portion is brought into contact with the male terminal, and a contact spring piece is elastically deformed. Due to the elastic deformation of the contact spring piece, the contact portion is brought into contact with the male terminal by urging force of the contact spring piece to be restored, and the connection terminal and the male terminal are electrically connected.

By the way, in the connection terminal according to the comparative example, a protective wall protruding toward an inside of a connection portion is provided at an opening edge of the insertion opening of the connection portion. A protruding end of the protective wall is arranged so as to be located on an inner side of the connection portion from a free end of the elastic piece. Therefore, a mating connection portion inserted into the inside of the connection portion through the insertion opening does not interfere with the free end of the elastic piece. By preventing the interference between the mating connection portion and the free end of the elastic piece in this way, for example, plastic deformation in a direction opposite to an elastic deformation direction of the elastic piece or in an insertion direction of the mating connection portion can be prevented, and the contact pressure between the mating connection portion and the contact portion can be maintained.

By the way, in the connection terminal according to the comparative example, when the mating connection portion is regularly inserted into the insertion opening, the protective wall can prevent the mating connection portion from interfering with the free end of the elastic piece. However, for example, when an erroneous insertion occurs in which the mating connection portion is inserted while being tilted with respect to the insertion opening, the mating connection portion passes over the protruding end of the protective wall, and the mating connection portion sometimes interferes with the free end of the elastic piece.

On the other hand, the connection terminal according to the comparative example is accommodated in a housing of a connector. A locking lance that can be bent is provided in the housing, and the locking lance engages with the connection terminal to prevent the connection terminal from coming off. When the connection terminal is removed from the housing for maintenance or the like, a release jig is inserted into the housing to bend the locking lance and disengage the locking lance from the connection terminal.

When the release jig is erroneously inserted, for example, while being tilted with respect to the insertion opening of the connection terminal, the release jig passes over the protruding end of the protective wall in the same manner as the erroneous insertion of the mating connection portion, and the release jig may interfere with the free end of the elastic piece.

Although the present embodiment has been described above, the present embodiment is not limited thereto, and various modifications can be made within the scope of the gist of the present embodiment.

In the present embodiment, the connection terminal is accommodated in the connector, but the present application is not limited to this, and is also effective in direct fitting between a connection terminal and a mating terminal without being accommodated in a connector. In this case, a member that may be erroneously inserted is the mating connection portion, and the elastic piece can be protected even when the mating connection portion is erroneously inserted.

The protective wall is formed by cutting and raising the bottom wall of the connection portion, but the present application is not limited to this, and a protective wall separate from the connection portion may be provided integrally with the connection portion by welding or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A connection terminal comprising:

a box-shaped connection portion having an insertion opening into which a mating connection portion is inserted; and an elastic piece that is elastically deformable, is arranged inside the connection portion, with an end portion on a side of the insertion opening as a free end, and has a contact portion that comes into contact with the mating connection portion, wherein the connection portion is provided with a protective wall having a protruding end protruding toward an inside of the connection portion and arranged adjacent to the free end of the elastic piece, and an end portion on a side of the free end of the elastic piece is arranged so as to intersect an extension line connecting the protruding end of the protective wall and an opening edge of the insertion opening facing the protruding end.

2. The connection terminal according to claim 1, wherein the protective wall is arranged on an inner side of the connection portion from the insertion opening.

3. The connection terminal according to claim 1, wherein a portion of the connection portion facing the free end of the elastic piece is provided with a hole into which the free end of the elastic piece can be inserted when the elastic piece is elastically deformed.

* * * * *